United States Patent [19]

Schwank

[11] 4,083,355

[45] Apr. 11, 1978

[54] GAS RANGE

[75] Inventor: Bernd Schwank, Cologne, Germany

[73] Assignee: Schwank GmbH, Cologne, Germany

[21] Appl. No.: 607,664

[22] Filed: Aug. 25, 1975

[30] Foreign Application Priority Data

Aug. 24, 1974 Germany ..... 2440701

[51] Int. Cl.[2] ..... F24C 3/04

[52] U.S. Cl. ..... 126/39 J; 431/285; 431/349

[58] Field of Search ..... 126/39 J, 39 E; 431/328, 349, 284, 285, 255

[56] References Cited

U.S. PATENT DOCUMENTS

| | | | |
|---|---|---|---|
| 3,028,909 | 4/1962 | Faure | 431/349 |
| 3,033,463 | 5/1962 | Doner et al. | 126/39 J X |
| 3,241,542 | 3/1966 | Lotter | 126/39 J |
| 3,562,562 | 9/1971 | Kreuter | 431/255 X |
| 3,606,612 | 9/1971 | Reid | 126/39 J X |
| 3,773,027 | 11/1973 | Dodd | 126/39 J |
| 3,843,313 | 10/1974 | Helgeson | 126/39 J X |

*Primary Examiner*—Edward G. Favors
*Attorney, Agent, or Firm*—Michael J. Striker

[57] ABSTRACT

The range has one or more burners. Above these is arranged a glass-ceramic plate. Each burner has a perforate ceramic element that is spaced from the plate by a distance just sufficient to permit the combustion gas to travel through this space. A thermal securing arrangement detects the temperature of the plate, and an adjusting arrangement permits adjusting of the burners, and therefore of the plate, to a plurality of different temperature levels.

24 Claims, 16 Drawing Figures

GAS RANGE

BACKGROUND OF THE INVENTION

This invention relates to a gas range in general, and more particularly to a gas range wherein the cooking surface is constituted by a glass-ceramic plate.

Conventional gas ranges have burners that are provided with a plurality of apertures from which flames issue when the burner is in use. Usually, the apertures are arranged in form of one or more rings. The pots, pans or the like to be heated are placed on support frames or similar structures which hold them in such a position above the burner, that the hottest parts of the flames come in contact with the bottom wall of the respective cooking utensil.

Burners of this type have certain disadvantages. The direct contact of the flames with the utensil can lead to local overheating, and result in burning of the contents of the utensil. The utensil must be precisely oriented relative to the burner, as dictated by the location of the flames and of the support frame, and cannot be positioned in any other way. Also, the flames and the combustion gases contact the utensils directly and this leads to blackening of the utensil over a period of time, which blackening is at least difficult to remove and sometimes cannot be removed at all.

Other types of gas burners are already from other applications, i.e. from space heating, heating of industrial furnaces or the like. These are radiation heaters, where the gas burns substantially without development of a flame, at the surface of a perforated ceramic plate. Burners of this type are usually provided with mixing tubes, usually Venturi-tubes, which are connected with the combustion gas source. Nozzles admit the combustion gas into the mixing tube, and the air and oxygen required to support combustion are drawn by an injector effect into the mixing tube where they mix with the gas. This mixture then travels into a housing that carries one or more perforated ceramic plates at the exposed (i.e. outwardly facing) surfaces of which the combustion takes place, heating the ceramic plate so that the latter yields intensive radiated energy. This type of burner has not been used in gas ranges, because boiling over of food or accidental spilling of food, would cause the ceramic plates to become contaminated and to cease proper operations. Such plates cannot be cleaned in the ordinary household and their use was therefore impractical in gas ranges.

Also known from the art are glass-ceramic plates, i.e. plates of a glass-crystalline material which is obtained from a special glass by thermal after-treatment. Glass-ceramic of this type is, for example, manufactured by the Corning Glassworks and has very unusual and highly advantageous properties, such as:

the linear thermal coefficient is expansion is almost zero;

maximum operating temperature is about 700° C;

the material is completely without pores;

the material has excellent resistance to chemicals;

the material is rather hard and therefore resistant to wear, especially to scratches;

the material is very resistant to breakage and attack by acids, lyes, and the like; and the material has food radiation permeability in the infra-red range at wavelengths of 0.4–5 mg.

SUMMARY OF THE INVENTION

It is a general object of the invention to provide an improved gas range.

In particular, it is an object to provide such an improved gas range which can be readily cleaned, is more aesthetically appealing than those of the prior art, and does not use open flames.

Another object is to provide such a gas range which avoids local overheating of utensils, such as pots and pans.

A further object is to provide such a gas range on which the utensils can be moved to any desired part of the cooking surface.

A concomitant object is to provide such a gas range in which the thermal energy of the combusted gas is better utilized than heretofore.

In keeping with these objects, and still others which will become apparent hereafter, one feature of the invention resides in a gas range which comprises an upper glass-ceramic plate; at least one burner below said glass-ceramic plate and including a perforate ceramic element spaced from said plate just sufficient for combustion gas to pass between them; thermal sensor means for sensing the temperature of said plate; and adjusting means for adjusting the temperature of said plate to a plurality of different temperature levels.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 2:
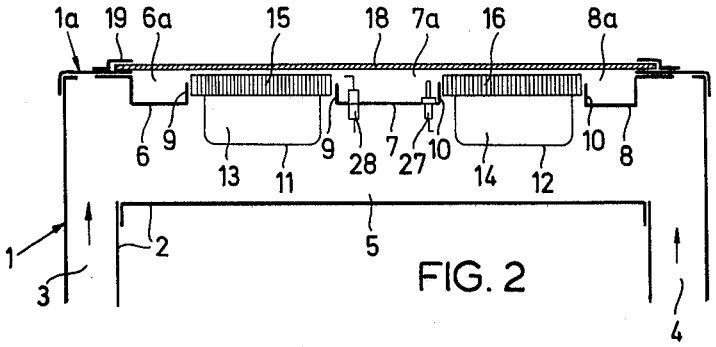
FIG. 2 is a section on line II—II of FIG. 1.
Figure 1:
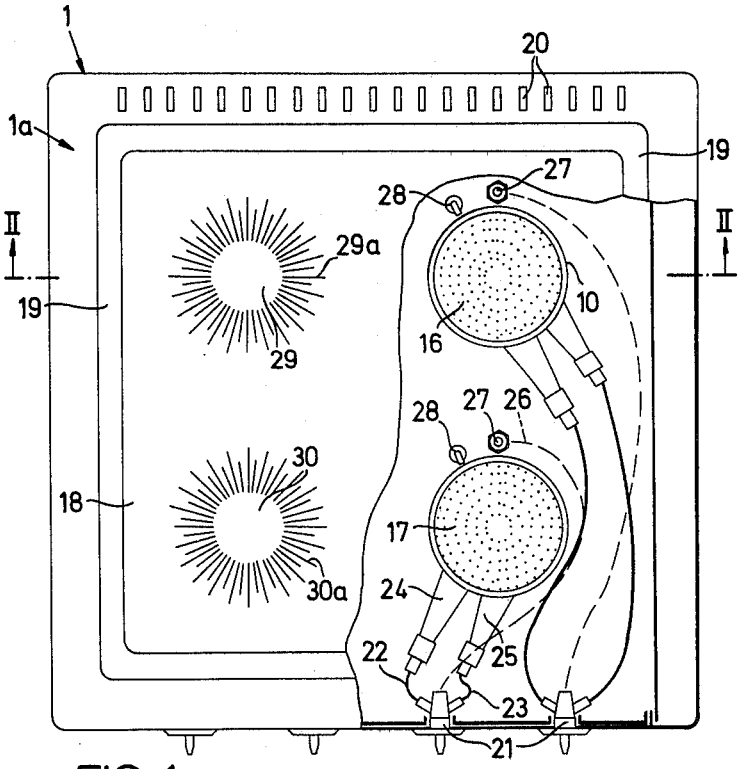
FIG. 1 is a top-plan view of a gas range of the invention, the glass ceramic plate being partly broken away.

The gas range in FIGS. 1 and 2 has a housing or frame provided with walls 1, 1*a* the lower part of which is provided with an oven 2, having an opening located at the front side of the range and closable with a (not illustrated) door in the usual manner.

The range is further provided with air shafts 3, 4 which are formed between the outer wall of the housing and the oven 2. The lower ends of these shafts 3, 4 are open to permit air to enter them in the vicinity of the floor and to flow (see the arrows in FIG. 2) into a space 5. From this space, combustion air is drawn to the burners by means of gas injectors which will be described subsequently.

Space 5 is bounded by the top wall of oven 2, the walls 1, 1*a* of the housing and a parition wall having the sections 6, 7 and 8. This partition wall is of one piece and formed with openings in cylindrical projections 9, 10. These openings are to receive the gas-fired radiant-heat burners each of which includes a casing 11, 12 which forms a burner space 13, 14 whose upper end is closed off by perforated ceramic burner plates 15, 16 and 17, respectively.

Above and spaced from ceramic burner plates 15, 16 and 17 the range is provided with a glass-ceramic plate 18 of the type discussed earlier. The upwardly directed surface of plate 18 is the cooking and warming surface of the range. The spacing between the underside of plate 18 and the upper (or radiating) sides of the burner plates 15, 16 and 17 is just large enough to permit the passage of combustion gases, i.e. about 10–15 mm. Plate 18 is framed in a chrome-nickel-steel frame 19 which is advantageously releasably connected with the upper housing wall 1*a*.

The space 6*a*, 7*a*, 8*a* (see FIG. 2) surrounding the burner plates 15, 16, 17 is bounded by the partition wall 6, 7, 8 and the plate 18; it is so dimensioned that it can accept the combustion gases which stream laterally off the burner peripheries. This space communicates with external openings 20 which are located at the side of the range facing away from an operator; openings 20 are advantageously short, spaced slots through which the combustion gases can escape upward, in a direction and at a location where they will not inconvenience a user. Of course, the space could have a single opening which might be connected to a flue or the like.

The burner chambers of the respective burners are each provided with a separate Venturi tube 24, 25 whose purpose it is to aspirate the entire quantity of required combustion air from the space 5, as will be described later.

A control device 21 is provided at the front side of the range, to permit the range to be turned on and off, and to allow the gas supply to be regulated. Gas lines 22, 23 lead from device 21 to the Venturi tubes 24, 25. In addition, the device 21 is connected via line 26 with a known electrically energizable ignition device 27 for igniting each of the burners. In lieu of, or in addition to this device 21, each burner may also be provided with a piezo-electric ignition device (also known per se) or a similar device. For the sake of clarity, the devices 27, 28 are shown at different locations in FIGS. 1 and 2. To guard against the outflow of uncombusted gas, a thermo-electric safety device may be provided which operates in accordance with the Peltier Effect Principle.

Figure 3:
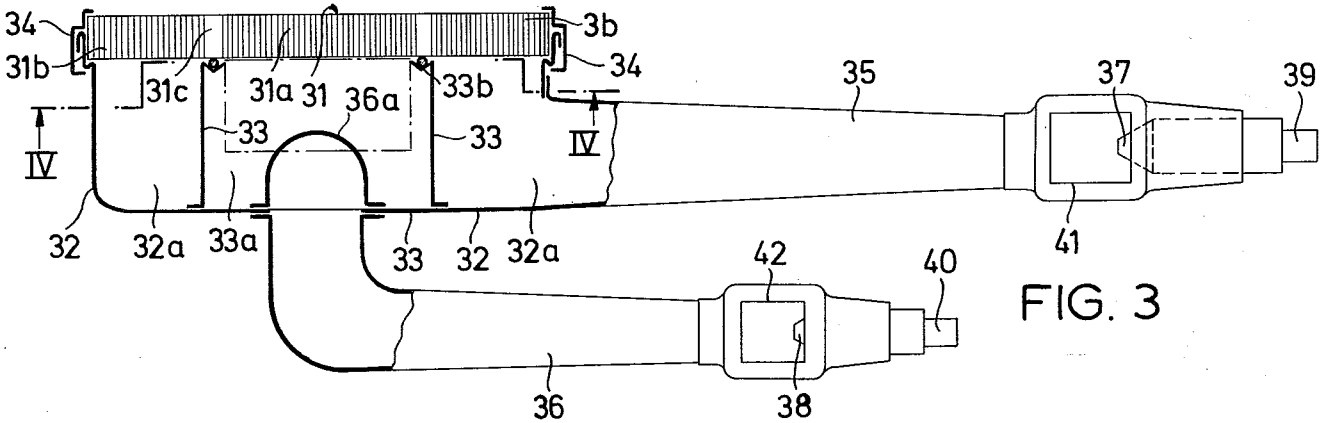
FIG. 3 is a side view of a burner of the range in FIG. 1, partly in vertical section.
Figure 4:
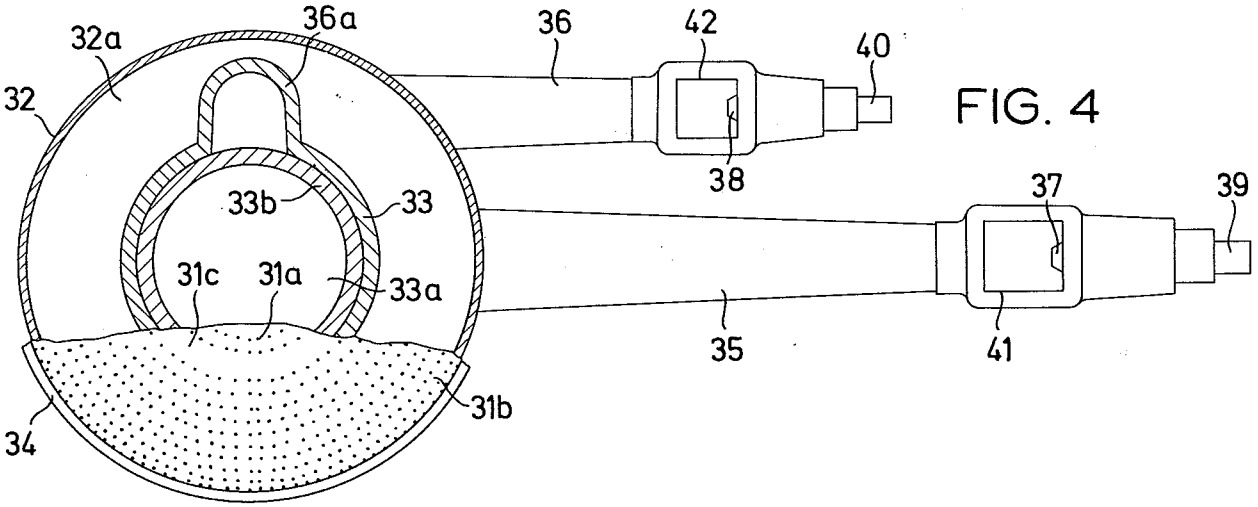
FIG. 4 is a plan view of FIG. 3, partly in section according to line IV—IV of FIG. 3.

One of the burners of FIG. 1 is shown in FIGS. 3 and 4 on an enlarged scale. It is representative of all of the burners and has two concentric burner chambers 32, 33. The ceramic burner plate 31 covering these chambers is held in place by a profiled ring 34 and composed of an inner circular portion 31*a* and an outer annular portion 31*b* which cover the chambers 32 and 33, respectively. Portions 31*a* and 31*b* are perforated; they may be separated by a non-perforated annular portion 31*c* whose underside is in engagement with the upper edge of chamber wall 33 via a sealing ring 33*b*. Each of the burner chambers 32, 33 is provided with its own Venturi-tube 35, 36, respectively, which are provided with gas connections 39, 40, nozzles 37, 38 and suction openings 41, 42 for the combustion air. If the tubes 35, 36 are arranged in parallel, the tube 36 must be connected with the inner burner chamber via an elbow 36*a*.

When the supply of gas to the burners has been initiated via operations of the device 21, the gas issues from the nozzles 37, 38 and, in so doing, creates a suction which produces aspiration of air from the space 5 into which additional air can enter from channels 3, 4. The aspirated air becomes mixed with the gas in the respective Venturi tube and within the chambers 32, 33 the mixture is uniformly distributed over the respective ceramic burner plate. The mixture penetrates through the perforations in the respective burner plate to the upper surface thereof where it becomes ignited, either by the catalytic action of an appropriate ignition device, by actuation of an electrically ignition device on the part of the user, or in another suitable manner. The respective burner plate becomes heated at its upper side where the gas burns without developing a flame, and radiates intensive heat which impinges upon the glass-ceramic plate 18. The latter becomes heated and, in undergoing the heating, also provides for uniform heat distribution. Only seconds after one of the burners has been activated, it will become visible (as being so activated) through the transparent or translucent material of plate 18 which becomes hot only in the region above and around the activated burner.

Evidently, cooking utensils can be shifted on plate 18 at will, so that their bottom wall overlaps the heated area to a greater or lesser degree, thus making possible a very precise fine adjustment of the cooking temperature which acts upon the utensil.

A further temperature adjustment is afforded if each burner is subdivided into a plurality of burner chambers, in the present instance the burner chambers 32, 33. This permits a three-stage temperature regulation. In case of a low setting or stage, used especially for small pots, only the inner chamber 33*a* receives fuel mixture so that only the middle circular portion 31*a* of the burner plate —corresponding to 29 or 30 in FIG. 1— becomes heated. In case of a medium setting the outer annular portion 31*b* receives fuel mixture and becomes heated. When high setting is selected, the portions 31 and 31*b* are both heated, so that the parts 29, 30 and 29*a*, 30*a* of plate 18 become heated.

The combustion gases flow radially outwardly in the space between burner plate 31 (equivalent to plates 15–17 in FIG. 1) and the underside of plate 18, to enter into spaces 6*a*, 7*a* and 8*a* from where they can freely flow to the slots 20. Since heating of plate 18 is essentially the result of radiation, the flowing combustion gases have at most a negligible effect on the heat transmission and, in fact, serve to uniformize heating by convection.

Figure 5:
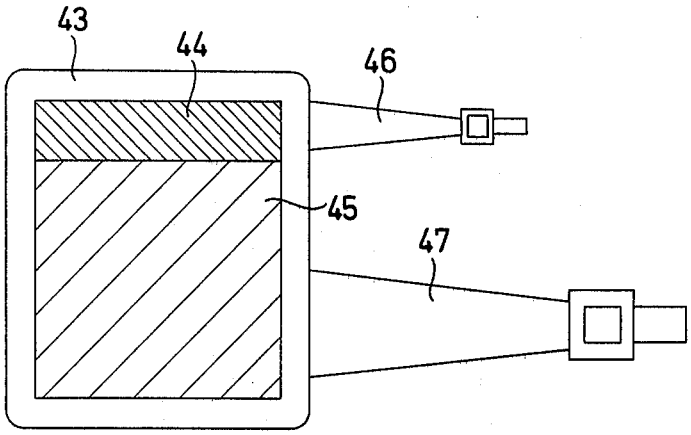
FIG. 5 is a plan view of a different burner.
Figure 6:
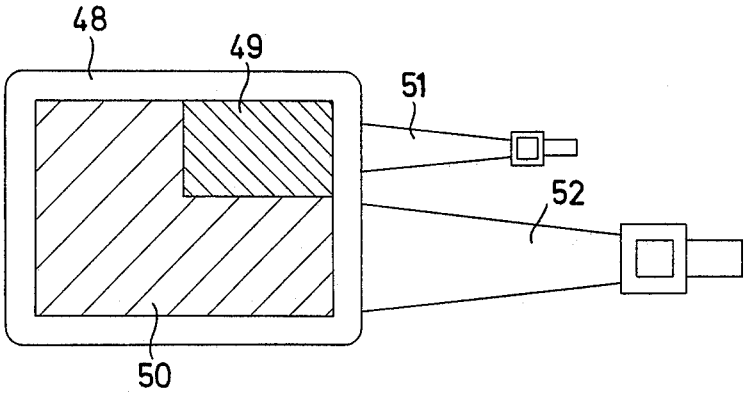
FIG. 6 is a plan view of another burner.

A different burner embodiment of rectangular shape, which can be used in lieu of the ones in FIGS. 3 and 4, is shown in FIGS. 5 and 6. If so, these burners —which otherwise correspond to those of FIGS. 3 and 4— are provided with rectangular frames 43, 48 into which rectangular perforated burner plates 44, 45, 49, 50 are inserted. These are each supplied with fuel mixture via a discrete Venturi tube 46, 47 and 51, 52, respectively.

Figure 7:
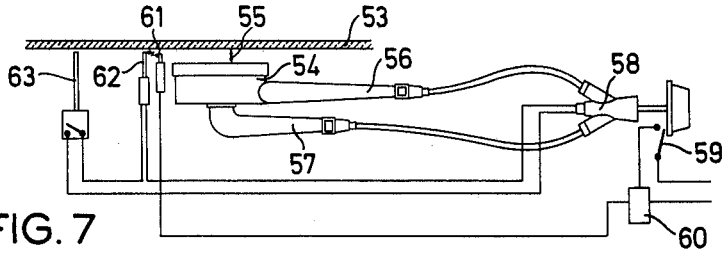
FIG. 7 is a view of still a further burner with diagrammatically shown ignition and safety devices.

Another embodiment of a burner is diagrammatically shown in FIG. 7. It has ignition and safety devices and is manually operated. Here, burner 54 is again located with shift spacing 55 below the glass-ceramic plate 53. It has two Venturi tubes 56, 57 which are constructed as described relative to FIG. 3 and which communicate via pipes with an armature 58 having a thermoelectric valve. A manually operable rotary knob operates a switch 59 for a spark generator 60 and opens the gas supply. Device 60 is connected with an ignition device 61 via an electric conductor. A thermoelement 62 and a safety switch 63 are also provided.

When the range is to be used and the knob turned, the gas supply is opened and the gas issuing from the burner is ignited. The temperature level of glass-ceramic plate 53 is sensed by thermoelement 62; regulation of the gas supply is effected manually via armature 58. A three-stage regulation is possible, in the manner described with reference to FIGS. 3 and 4. Fine regulation is effected by throttling the loading of the outer annular burner surface. The safety switch 63 has a temperature sensor whose electrical contact is connected in series with the thermocurrent circuit of the element 4 and opens when a maximum permissible ambient temperature is exceeded.

Figure 8:
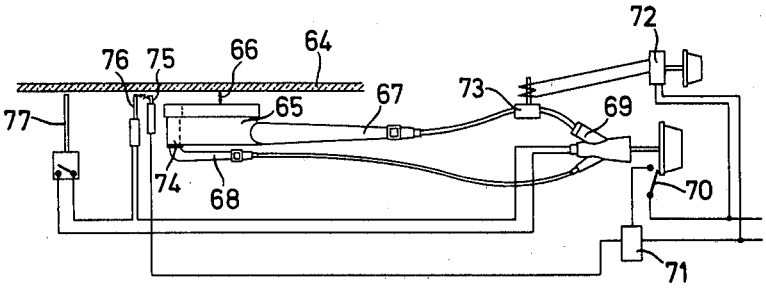
FIG. 8 is a view analogous to FIG. 7, but showing a different burner construction.

Another embodiment, serving the same purpose as the one in FIG. 7 but designed for partly automatic operation, is shown in FIG. 8. A burner 65 is arranged at a relatively small distance 66 beneath a glass-ceramic plate 64. The embodiment in FIG. 8 is designed to provide, in addition to regular heating operation, a mini-heat stage. At or in the region of the burner margin, or rather the margin of the ceramic burner plate, there is provided a small, separate compartment 74 which serves as a pilot burner. The heat output produced by this pilot burner is chosen to be so low that even the most delicate foods or other items placed onto the glass-ceramic plate 64 cannot burn.

The burner 65 with its various chambers and the compartment 74 receives the necessary combustible mixture via Venturi tubes 67, 68. The flow of gas from the source to the burner 65 is controlled by a hand-operated valve 69 which at the same time also actuates the spark generator 71 via a switch 70. The spark generator is electrically connected with an ignition device 75. Supervision of the arrangement to prevent difficulties is effected by a thermoelement 76 and a safety switch 77 in the manner described relative to FIG. 7. The main burner is supplied with fuel gas via a magnet valve 73 which is periodically switched off and on by an energy regulator 72. The latter advantageously has several (e.g. twelve) switching stages, so that it is possible to vary the time intervals during which the valve 73 is energized and de-energized.

Although FIGS. 7 and 8 each show only a single burner to explain the respective embodiment, it is evident that the gas range can have any desired number of these burners.

Figure 9:
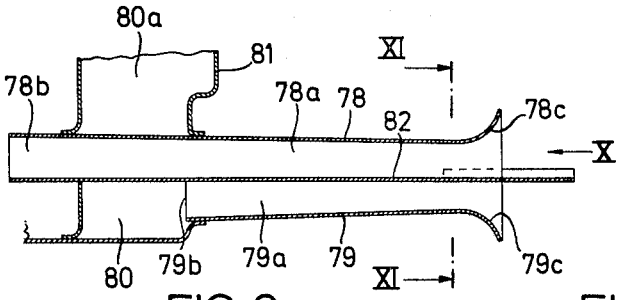
FIG. 9 is a vertical section through a mixing tube.
Figure 10:
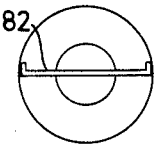
FIG. 10 is a view of the tube in FIG. 9, seen in the direction of the arrow X.
Figure 11:
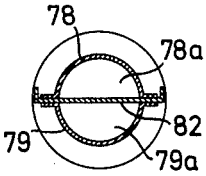
FIG. 11 is a section on line XI—XI of FIG. 9.

A special embodiment of a unitary Venturi tube for use with the range of the present invention, is shown in FIGS. 9–11. This tube has an upper part 78 with inlet **78*c* and outlet 78*b*, and a lower part 79 with inlet 79*c* and outlet 79*b*. Parts 78 and 79 are separated by a longitudinal wall 82 so that flow paths 78*a*, 79*a* are formed which each communicate with one of the burner chambers. One of these is shown in the drawing, being identified with reference numerals 80, 80*a*. It is the outer annular chamber and is bounded by an outer wall 81**.

Figure 12:
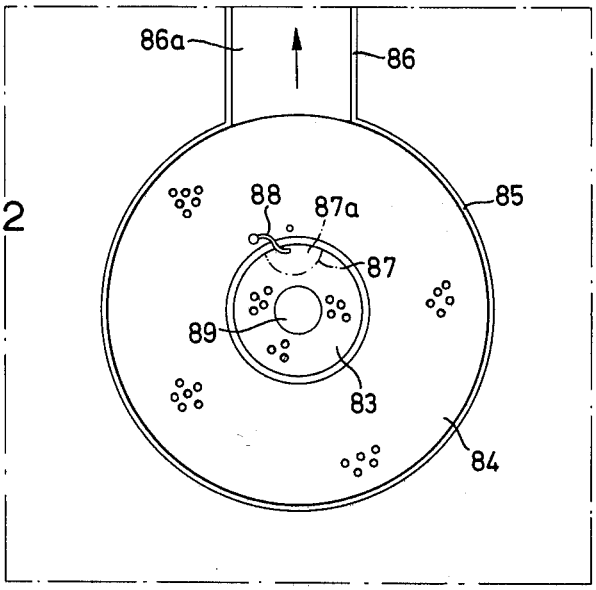
FIG. 12 is plan view of yet an additional burner embodiment.
Figure 13:
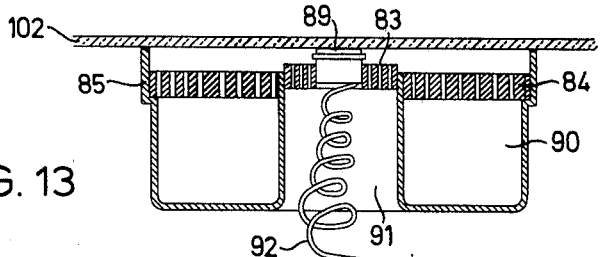
FIG. 13 is a vertical section through the burner in FIG. 12.
Figure 14:
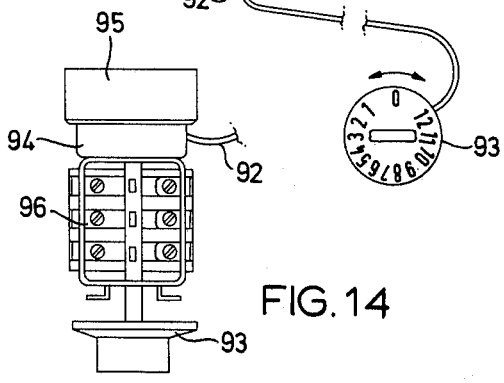
FIG. 14 is a plan view, showing part of the range controls.

Still a further embodiment of a burner is shown in FIGS. 12–14. This burner is also located, together with others that have not been shown, beneath a common glass-ceramic plate 102 which is partly shown in chain lines. This burner has a main burner chamber 90, advantageously of annular shape, which is covered by a ceramic burner plate 84. Chamber 90 surrounds a central circular chamber 91 which is covered by a circular ceramic burner plate 83. It is advantageous if the plate 84 is set slightly lower than the plate 83.

The embodiment of FIGS. 12–14 is suitable for automatic cooking, i.e. cooking wherein the cooking temperature is automatically controlled. For this purpose it is provided at the center of the radiating surface defined by plates 83 and 84 with a contact thermostat 89 which is springbiased against the underside of glass-ceramic plate 102. Such thermostats are know per se; the liquid type is preferable among those that are known. A liquid-filled tube 92 leads from thermostat 89 to a liquid-filled chamber 94 accommodating a (not illustrated) diaphragm which can be prestressed to a selectable extent by turning of a knob 93. This prestressing causes the diaphragm to exert a greater or lesser stress upon the liquid, and this in turn serves to regulate the heat output of the burner and to effect turning-on and turning-off of the gas supply via a magnet valve in dependence upon the selected pressure. In addition, thermostat 89 supervises and controls the surface temperature of the glass-ceramic plate 102. Reference numerals 95 and 96 designate electric switches which control the energization and de-energization of the ignition device 88 for the burner.

A small ceramic burner plate section **87*a* is provided at the margin of the inner burner plate 83, as shown by the chain line. Located beneath it is the electric ignition device 88. The plate section 87*a* may serve as a pilot burner. The outer burner plate 84 is surrounded by a cylindrical thermally insulating member 85, preferably of fire-proof ceramic fibers. The upper edge of member 85 abuts the underside of the glass-ceramic plate 102. Member 85 is provided with an opening which communicates with a discharge conduit 86 (preferably of the same material as member 85) so as to form a flow path 85*a*** for the combustion gases.

The above described burners, or even a single-chamber radiant burner, permit automatic operation of the range if an ignition device is provided which automatically turns on and ignites the burner or burners. An energy regulator can be provided to periodically switch the burner off and on. After a shut-down period, set by the energy regulator, has expired, the burner is automatically started up again. The energy regulator may be replaced with a thermostat for automatic cooking.

Figure 16:
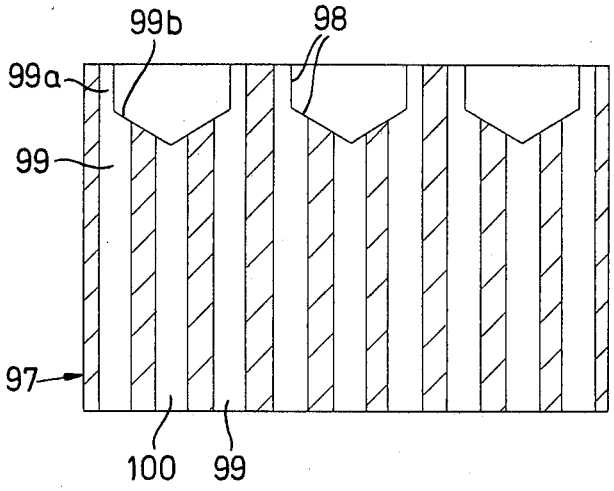
FIG. 16 is a section on line XVI—XVI of FIG. 15.
Figure 15:
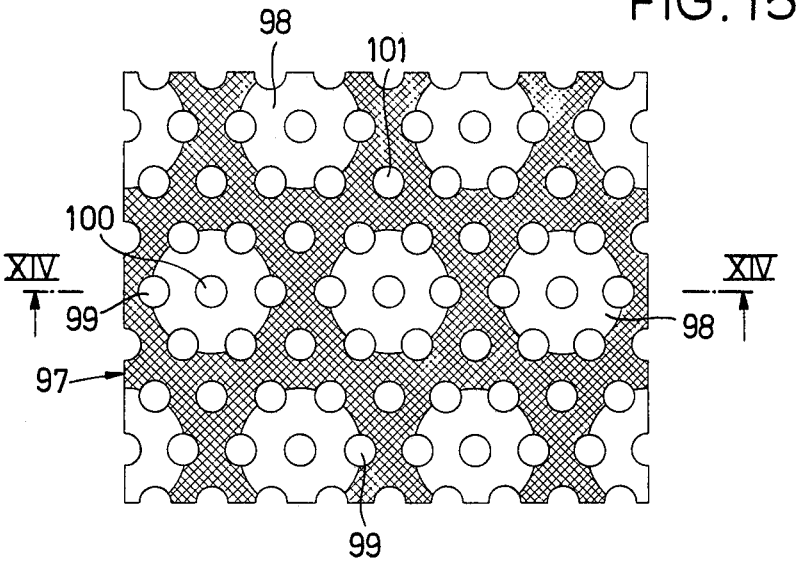
FIG. 15 is a plan view, showing part of a special perforated ceramic burner element.

Finally, FIGS. 15 and 16 illustrate a portion of a ceramic burner plate 97 which is especially advantageous because it offers very uniform and intensive infrared radiation.

The burner plate 97 has many combustion channels 99, 100 and 101 which extend parallel to one another and terminate at the radiation side in a special manner in depressions 98. These latter have a cylindrical circumference; the combustion channels are centrically grouped about the cylinder axis of the respective depression 98 that their own center axes coincide with the cylindrical circumference. Thus, the communication opening of each channel 99 is composed of two parts 99*a* and 99*b*, which are located in different planes and of which the inner part 99*b* is formed in the bottom of the depression 98 and is bounded from that arcuate edge of the cylinder wall which intersects with the bottom wall at the side away from the radiating surface. The part 99*a*, on the other hand, is located at the level of the radiating surface of the burner plate 97.

It is advantageous if each depression 98 has sit of the combustion channels associated with it. At the center of the bottom of each depression the latter communicates with a further channel 100, and a channel 101 opens at a point equidistant from any three adjacent ones of the depressions 98. It has been found that a burner plate so constructed provides for particularly intense and highly uniform heat radiation.

It will be understood that each of the elements described above, or two or more together, may also find a useful application in other types of constructions differing from the types described above.

While the invention has been illustrated and described as embodied in a gas range, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A gas range, comprising an upper glass-ceramic plate; at least one burner below said glass-ceramic plate and including a perforated ceramic element spaced from said plate by substantially 10–15 mm; thermal sensor means for sensing the temperature of said plate; gas supply means for said burner including control means for periodically activating and deactivating said gas supply means in dependence upon the temperature of said plate sensed by said thermal sensor means; and adjusting means for adjusting the temperature of said plate to a plurality of different temperature levels.

2. A gas range as defined in claim 1, wherein said burner is constructed for the gas to undergo substantially flameless combustion at a surface of said element.

3. A gas range as defined in claim 1; further comprising igniting means associated with said burner.

4. A gas range as defined in claim 1; and further comprising a piezo-electric ignition device associated with said burner.

5. A gas range as defined in claim 1; and further comprising ignition means associated with said burner and including an electrically energizable ignition device.

6. A gas range as defined in claim 1; and further comprising Peltier-type thermo-electric safety means for preventing the outflow of gas in uncombusted state from said burner.

7. A gas range as defined in claim 1, wherein said burner has two internal chambers.

8. A gas range as defined in claim 1, wherein said burner has a plurality of internal chambers.

9. A gas range as defined in claim 8, wherein said chambers are concentric with one another.

10. A gas range as defined in claim 8, wherein said burner further comprises a separate air-inlet Venturi tube for each of said chambers, for admission of the total quantity of combustion air required to operate said burner.

11. A gas range as defined in claim 8, wherein said element and chambers are of rectangular outline.

12. A gas range as defined in clam 1; further comprising a closed air-supply space below said burner and provided with at least one upright shaft for ambient air, said burner being adapted to draw combustion air from said space by a gas injector.

13. A gas range as defined in claim 1, wherein said adjusting means comprises selecting means for selecting three of said levels, namely a high level, an intermediate level and a low level, by permitting combustion of gas over different portions of the surface of said element.

14. A gas range as defined in claim 1, wherein said thermal sensor means comprises an electric sensor having a circuit which is interrupted when said sensor detects that the temperature of said plate exceeds a predetermined value.

15. A gas range as defined in claim 1, wherein said thermal sensor means comprises an electric sensor having a circuit which is interrupted when said sensor detects that the temperature of said combustion gas exceeds a predetermined value.

16. A gas range as defined in claim 1, said element having a marginal zone formed with a small discrete combustion chamber which constitutes a pilot burner.

17. A gas range as defined in claim 1, wherein said gas supply means for said burner, comprise a magnet valve said control means being arranged for periodically activating and deactivating said magnet valve.

18. A gas range as defined in claim 17, wherein said control means comprises a multi-stage regulator for varying the duration of the periods for which said magnet valve is activated and deactivated, respectively.

19. A gas range, as defined in claim 1, wherein said thermal sensor means for sensing the temperature of said plate comprise a contact thermostat in biased contact with said plate.

20. A gas range as defined in claim 19, said element having a surface from which heat is radiated; and wherein said contact thermostat is located at the center of said surface.

21. A gas range as defined in claim 19, said element having an inner circular portion and a surrounding outer annular portion having a first and a second section of said surface, respectively; and wherein said thermostat is centrally mounted on said inner portion and the surface section of said outer portion is slightly depressed relative to that of said inner portion.

22. A gas range as defined in claim 1, said burner having two internal chambers and two air-aspirating Venturi tubes, one for each chamber, said Venturi tubes forming a structural unit with one another.

23. A gas range as defined in claim 1, said burner having an inner and a surrounding outer burner chamber, thermal insulation surrounding the outer circumference of said outer chamber and having an upper edge abutting said plate, said thermal insulation being formed with an opening which communicates with a combustion-gas outlet channel.

24. A gas range as defined in claim 23, wherein said thermal insulation comprises ceramic fibers.

* * * * *